US009943716B2

(12) United States Patent
Vaneerden et al.

(10) Patent No.: US 9,943,716 B2
(45) Date of Patent: Apr. 17, 2018

(54) CONCEALED RESIDENTIAL SPRINKLER

(71) Applicant: The Viking Corporation, Hastings, MI (US)

(72) Inventors: David Vaneerden, Middleville, MI (US); Thomas E. Winebrenner, Hastings, MI (US)

(73) Assignee: THE VIKING CORPORATION, Hastings, MI (US)

( * ) Notice: Subject to any disclaimer, the term of this patent is extended or adjusted under 35 U.S.C. 154(b) by 291 days.

(21) Appl. No.: 14/798,997

(22) Filed: Jul. 14, 2015

(65) Prior Publication Data

US 2015/0314154 A1 Nov. 5, 2015

Related U.S. Application Data

(62) Division of application No. 12/405,788, filed on Mar. 17, 2009, now Pat. No. 9,114,267.

(51) Int. Cl.
*A62C 37/12* (2006.01)

(52) U.S. Cl.
CPC ..... *A62C 37/12* (2013.01)

(58) Field of Classification Search
CPC ..... A62C 37/12
See application file for complete search history.

(56) References Cited

U.S. PATENT DOCUMENTS

| | | | | |
|---|---|---|---|---|
| 399,521 | A | | 3/1889 | Grinnell |
| 2,591,872 | A | | 4/1952 | Rider |
| 3,061,016 | A | | 10/1962 | Hodgman, Jr. |
| 3,195,647 | A | * | 7/1965 | Campbell ..... A62C 37/09 137/72 |
| 3,459,266 | A | | 8/1969 | Ault |
| 3,714,989 | A | | 2/1973 | Gloeckler |
| 3,783,947 | A | | 1/1974 | Dix et al. |
| 3,880,239 | A | | 4/1975 | Vorkapich |
| 3,904,126 | A | | 9/1975 | Allard |
| 4,014,388 | A | | 3/1977 | Anderson |
| 4,066,129 | A | | 1/1978 | Anderson |
| 4,214,631 | A | | 7/1980 | Hattori |
| 4,217,960 | A | | 8/1980 | Miyazaki |

(Continued)

FOREIGN PATENT DOCUMENTS

WO 2008/067421 A2 6/2008

*Primary Examiner* — Ryan A Reis
(74) *Attorney, Agent, or Firm* — Harness, Dickey & Pierce, P.L.C.

(57) ABSTRACT

A combined trigger and concealing device for an automatic fire protection sprinkler includes a first plate attached to a second plate by a heat fusible material. Each plate is formed with an aperture which receives an actuator depending from the bottom of the sprinkler. The trigger device depends a preselected distance from the bottom of the sprinkler body and includes a cover which has an outer dimension which conceals the internal components of the sprinkler from view. The cover includes openings and is dimensioned and positioned to permit heat energy to be received by the inner and outer surface of the trigger device. Conduction of heat energy from both the inner and outer surface of the trigger device permits the heat fusible material to be expeditiously raised to the preselected separation temperature. This construction minimizes response time of the sprinkler while maintaining a highly aesthetic appearance.

15 Claims, 7 Drawing Sheets

(56) References Cited

U.S. PATENT DOCUMENTS

| | | | | | |
|---|---|---|---|---|---|
| 4,296,815 | A | | 10/1981 | Mears | |
| 4,296,816 | A | | 10/1981 | Fischer | |
| 4,596,289 | A | * | 6/1986 | Johnson | A62C 37/09 169/37 |
| 4,651,832 | A | | 3/1987 | Kubo | |
| 4,660,648 | A | | 4/1987 | Zen | |
| 4,830,117 | A | | 5/1989 | Capasso | |
| 4,880,063 | A | | 11/1989 | Leininger et al. | |
| 4,926,946 | A | * | 5/1990 | Polan | A62C 37/09 169/37 |
| 4,977,963 | A | | 12/1990 | Simons | |
| 4,987,957 | A | | 1/1991 | Galaszewski | |
| 5,020,601 | A | | 6/1991 | Retzloff et al. | |
| 5,117,916 | A | | 6/1992 | Ohta et al. | |
| 5,447,338 | A | | 9/1995 | Kikuchi | |
| 5,497,834 | A | | 3/1996 | Onuki | |
| 5,669,449 | A | | 9/1997 | Polan et al. | |
| 5,722,599 | A | | 3/1998 | Fries | |
| 5,727,737 | A | | 3/1998 | Bosio et al. | |
| 6,098,718 | A | | 8/2000 | Sato | |
| 6,112,821 | A | | 9/2000 | Yokoi | |
| 6,129,153 | A | | 10/2000 | Joung | |
| 6,152,236 | A | * | 11/2000 | Retzloff | A62C 37/09 169/19 |
| 6,439,315 | B2 | | 8/2002 | Onuki | |
| 6,520,265 | B2 | * | 2/2003 | Winebrenner | A62C 31/02 169/37 |
| 6,805,203 | B2 | | 10/2004 | Retzloff et al. | |
| 6,962,208 | B2 | * | 11/2005 | Franson | A62C 37/09 169/16 |
| 7,104,335 | B2 | | 9/2006 | Shim | |
| 9,114,267 | B2 | * | 8/2015 | VanEerden | A62C 37/12 |

* cited by examiner

FIG 5
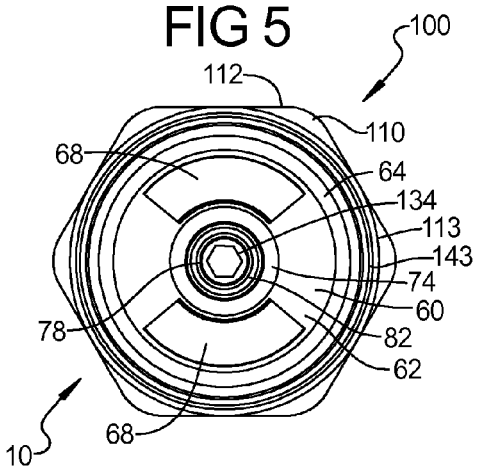
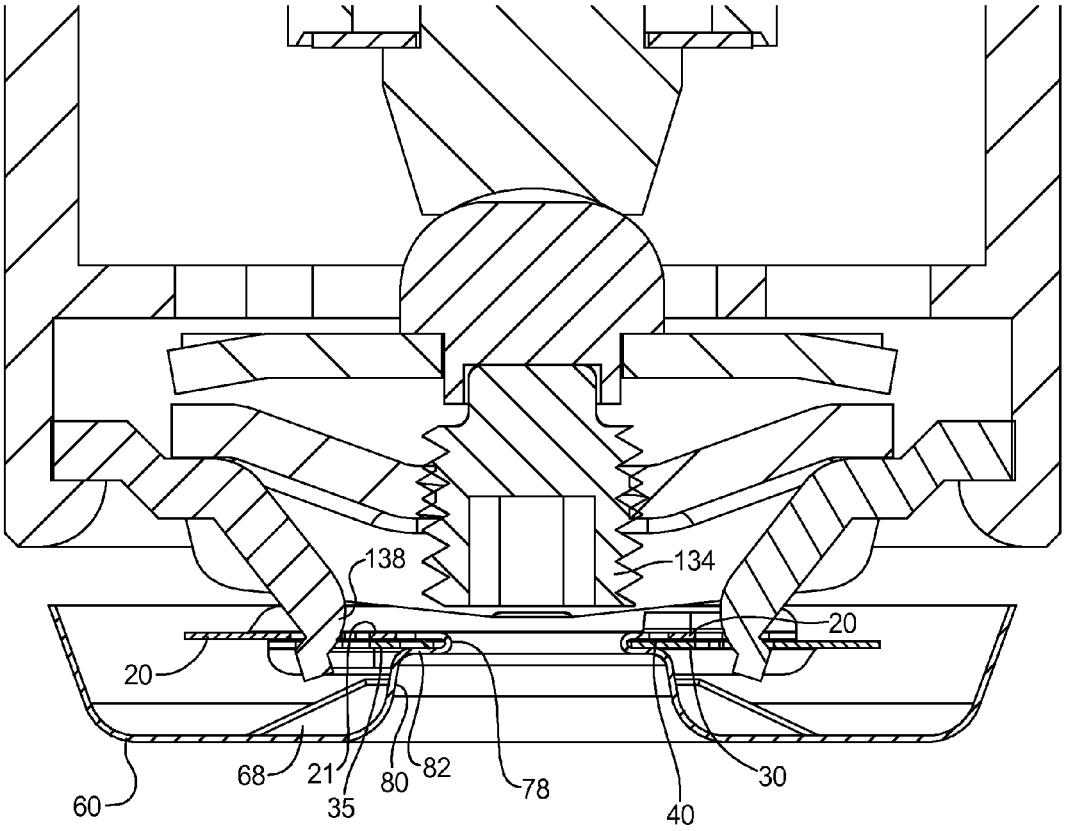
FIG 6

FIG 7
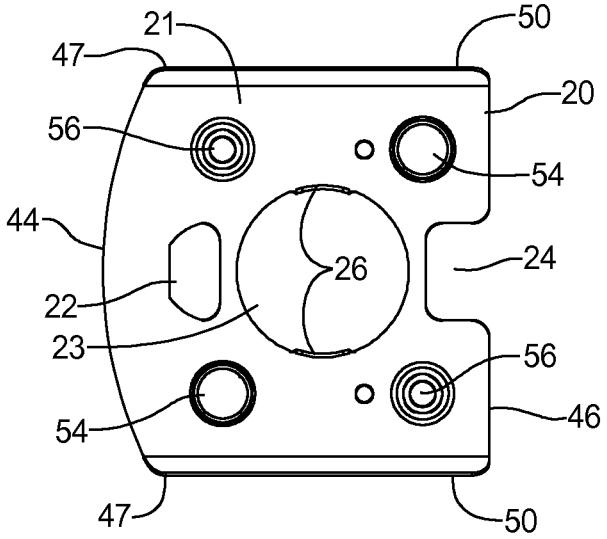
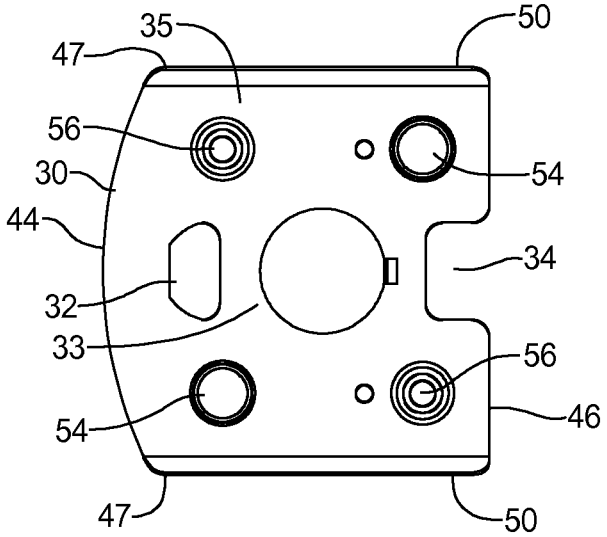
FIG 8

FIG 9
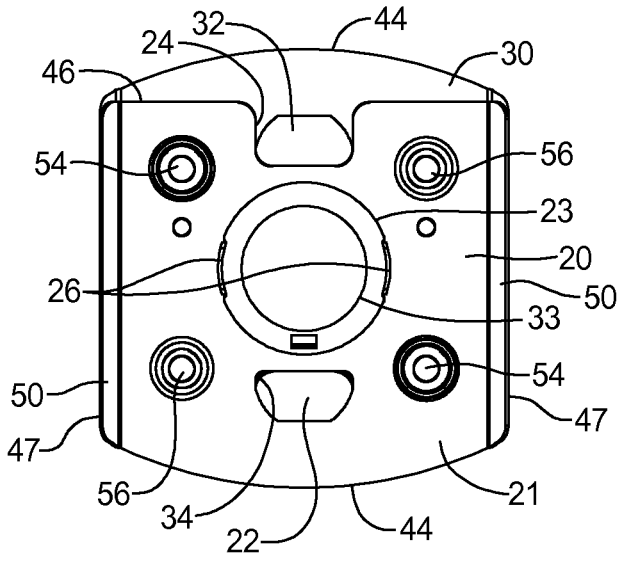
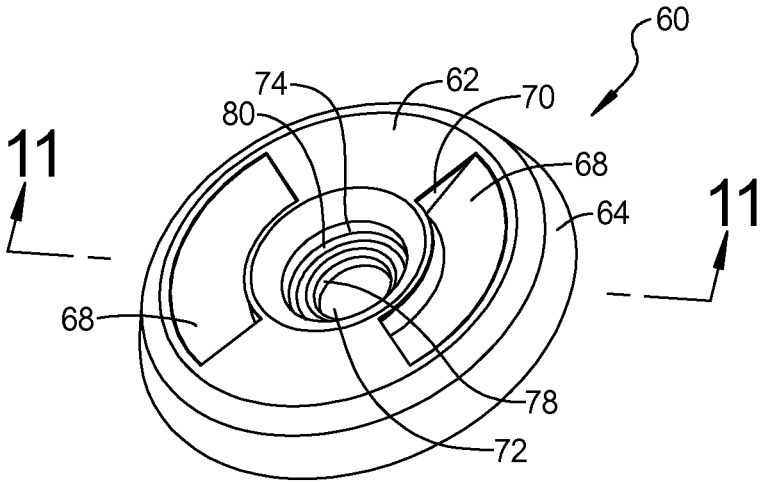
FIG 10

CONCEALED RESIDENTIAL SPRINKLER

CROSS-REFERENCE TO RELATED APPLICATIONS

This application is a divisional of U.S. patent application Ser. No. 12/405,788, filed Mar. 17, 2009(now U.S. Pat. No. 9,114,267, issued Aug. 25, 2015). The entire disclosure of the above application is incorporated herein by reference.

FIELD

The present disclosure relates to fire protection sprinklers used in automatic fire extinguishing systems for buildings and the like, and in particular, relates to concealed automatic sprinklers having a triggering element used to initiate opening of the fluid flow orifice of the sprinkler.

BACKGROUND

Sprinklers have long been used in automatic fire extinguishing systems in order to controllably disburse a fluid to suppress or extinguish a fire in a designated area. Typically, the fluid utilized in automatic fire extinguishing systems is water, however systems have also been developed to disburse other fire extinguishing fluids. In one common design, sprinklers include a solid metal base with an inlet connected to a pressurized supply of water or other fire extinguishing fluid, and a deflector which alters the trajectory of the water in an optimum pattern when discharged from the base outlet orifice. In many conventional sprinklers the deflector is fixedly spaced from the outlet by a pair of rigid arms and mounted on a boss joining the arms. A trigger element is positioned between the deflector boss and the outlet orifice closure seal.

In another common recessed, pendant version of the sprinkler, the deflector is movable and stored proximate to the base. A housing extends around the deflector and sprinkler body and forms a recess up into the ceiling in which the sprinkler is located. A fluid seal, also positioned within the interior of the sprinkler, is maintained in the closed position by a pair of levers or actuators depending below the bottom of the sprinkler body. The levers are held in an inwardly biased or closed position by a trigger mechanism which is thermally responsive in the temperature range indicative of a fire. The trigger mechanism is commonly a thermally sensitive fusible link. Thus, under normal temperatures, the presence of the thermally sensitive fusible link prohibits fluid flow from the sprinkler. When the temperature within the designated area rises to a preselected value due to a fire, the fusible link separates, causing the levers to move in an outward direction and thus permits downward movement of the deflector plate from the interior of the sprinkler to a preselected distance within the interior of the designated area. The separation of the fusible link also opens the fluid seal, thereby enabling pressurized water to travel through the sprinkler and into the designated area in order to suppress or extinguish a fire.

The prior art has advanced fusible link trigger mechanisms which also function to conceal the bottom outlet of the sprinkler. For example, U.S. Pat. No. 4,596,289 issued to Johnson discloses a combined trigger element and concealing mechanism having two complementary strut retaining members which maintain the fluid seal in a closed position. The outer surfaces of these strut retaining members are joined by a heat fusible material which is covered by a heat conductive cover. In this design, the bottom outlet of the sprinkler is entirely enclosed by the combined trigger and concealing mechanism. In a similar design, U.S. Pat. No. 3,783,947 issued to Dix et al. advances a combined cover and trigger mechanism having a cover member which completely encloses the open portion of the bottom of the sprinkler. The cover member is attached to a lever in operational contact with a strut. This strut maintains a fluid seal in the closed position under normal temperatures. The cover member is attached to the interior surface of the sprinkler body by a heat fusible tab. When this heat fusible tab is exposed to a preselected temperature, its thermal degradation causes the release of the cover member which in turn imparts movement of the lever mechanism, and hence actuates the strut to thereby open the fluid seal.

In both of these designs, the cover mechanism entirely encloses the bottom of the sprinkler, with the heat fusible material being located on the interior surface of the cover. When the temperature is elevated due to the presence of a fire in the designated area, the thermal energy issued from the fire is constrained to pass in an upward direction from the outer surface of the cover member towards the heat sensitive compound. Since the cover member completely encloses the bottom region of the sprinkler, the inner surface of the cover member and the heat sensitive agent remains at ambient or near ambient conditions until thermal energy penetrates the cover member and reaches the heat sensitive agent. As a consequence of the prior art combined trigger and concealing mechanisms, the responsiveness of the sprinkler to which they are attached is often reduced. That is, when a fire occurs in the designated area, the temperature of the room may be at the preselected temperature at which the sprinkler is to be actuated. However, because conduction is forced to occur in only one direction, there is a time gap between the achievement of a particular room temperature and the actuation of the sprinkler. Delayed actuation of a sprinkler in the presence of a fire is unacceptable because such delay may provide a sufficient time period for which the fire to spread outside of the designated area.

Consequently, there exists a need for a responsive and reliable combined trigger and concealing device which overcomes the difficulties encountered by the prior art.

SUMMARY

The present disclosure overcomes the difficulties confronted by the prior art by providing a combined trigger and concealing device for a sprinkler which permits heat energy to impact both the exterior and interior surface to thereby provide a more responsive and reliable trigger mechanism.

According to one aspect of the present disclosure, the combined trigger and concealing device includes a first plate joined to a second plate by a layer of fusible material. Each of the plates is dimensioned to receive a lever and maintain the same in an inwardly biased or closed position. A cover is attached to one of the plates and is sized to obscure the internal components of the sprinkler from view. The triggering device depends a preselected distance below the bottom of the sprinkler body and defines a passage between the bottom of the sprinkler body and the cover. The passage provides a fluid path, enabling transference of heat energy to the plates. This in turn assures a timely release of the plates when a preselected temperature is experienced.

According to a preferred aspect of the disclosure, the cover is formed with a plurality of apertures in a face of the cover. The apertures each define a passage through the cover. The passages through the cover provide fluid paths, enabling transference of heat energy to the plates. This in turn assures a timely release of the plates when a preselected temperature is experienced.

Preferably, the periphery of the cover is curved upward to form a rim. This rim collects and traps heat energy released during a fire about the trigger device. Accordingly, the thermally sensitive compound will degrade at a proper rate, thereby ensuring timely activation of the sprinkler in response to a fire.

The response time of the sprinkler is thus minimized while maintaining a highly aesthetic appearance. These and other advantages, benefits and objects will be understood by one skilled in the art from the drawings, description and claims which follow.

DRAWINGS

FIGS. 1 and 2 are plan views of a fire protection sprinkler with the combined trigger and concealing device according to the present disclosure;

FIGS. 3 and 4 are cross-sectional views of the combined trigger and concealing device and sprinkler along lines 3-3 and 4-4 of FIGS. 1 and 2, respectively;

FIG. 5 is a bottom plan view of the combined trigger and concealing device and sprinkler depicted in FIGS. 1 and 2;

FIG. 6 is an enlarged fragmented view within circle 6-6 of FIG. 3;

FIGS. 7 and 8 are top and bottom plan views of a first and second plate, respectively, of a combined trigger and concealing device according to the disclosure;

FIG. 9 is a top plan view of the first and second plates of FIGS. 7 and 8 attached together with a heat fusible material according to the disclosure;

FIG. 10 is a perspective view of a cover of a combined trigger and concealing device according to the disclosure;

DETAILED DESCRIPTION

Figure 2:
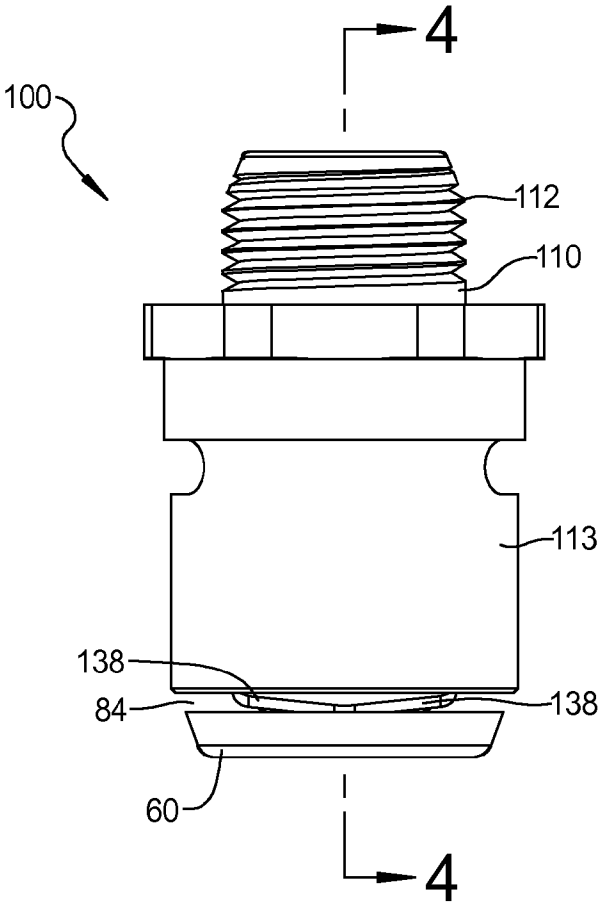
Figure 1:
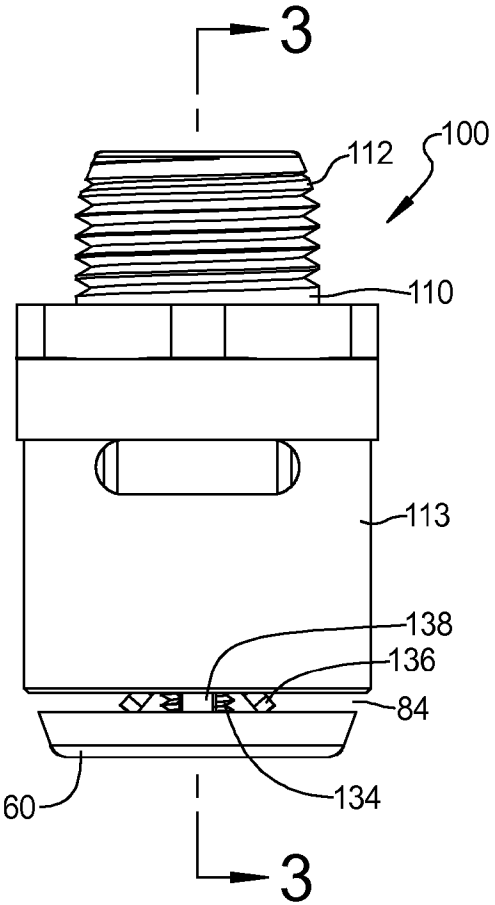

The present disclosure is embodied in a unique combined trigger and concealing device for a fire protection sprinkler 100. The present disclosure provides a trigger device which by its structure permits heat energy to penetrate both the interior and exterior surfaces. Exposure to thermal energy on both surfaces of the device yields a responsive trigger device which rapidly causes the actuation of the sprinkler when the temperature reaches a preselected value as a result of a fire.

Referring now to FIGS. 1 through 4, an automatic sprinkler 100 normally contains a body 110 which may be a two-piece assembly and have an upper section 112 and a lower section 113. Upper section 112 includes upper external threads 115, allowing removable attachment with a pipe positioned within the ceiling (not shown). This pipe is in fluid communication with a source of pressurized water or other fire extinguishing fluid. Upper section 112 includes lower external threads 117, allowing removable attachment with lower section 113 via internal threads 119. Upper section 112 of body 110 is in fluid communication with the interior 114 of body 110. Disposed about the lower region of interior 114 of body 110 is a deflector 116. Guide bolts 118 are positioned within apertures 120 of deflector 116 in order to be fixedly secured to deflector 116. Guide bolts 118 extend through guide holes 122 formed in rim 124 of lower section 113 of body 110.

Residing within the central bore of deflector 116 is a seal closure member 126. The top surface 128 of seal closure member 126 supports a plug 129 and a fluid seal 130. Plug 129 and fluid seal 130 are in fluid communication with the interior 114 of upper section 112 of body 110 and, when compressed against the seat of upper section 112 by top surface 128, forms a fluid-tight seal.

An adjustment plate 136 is positioned immediately below deflector 116 and seal closure member 126. An adjustment screw 134 is threaded through a central bore in adjustment plate 136 and presses upwardly against a recess in seal closure member 126. The upper ends of a pair of spring biased actuators or levers 138 are seated above a lip 140 formed about bottom region 142 of lower section 113 of body 110. Levers 138 extend beneath adjustment plate 136 and hold adjustment plate 136 in place. Trigger and concealing device 10 prevents levers 138 from separating. With adjustment plate 136 so secured, the turning of adjustment screw 134 adjusts the closure pressure on seal closure member 126 and fluid seal 130.

Figure 12:
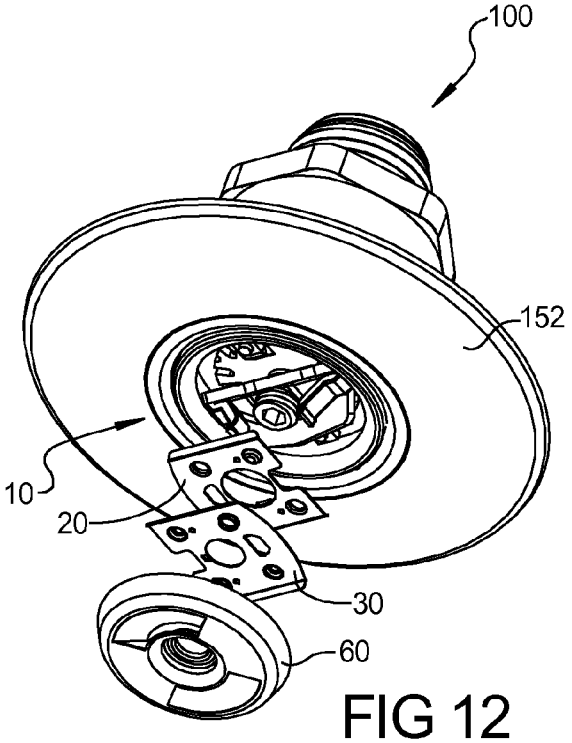
FIGS. 12 and 13 are perspective, partially exploded views of the combined trigger and concealing device and sprinkler of FIG. 1 with an escutcheon thereon.

Levers 138 are biased in the outward position and depend a preselected distance below bottom region 142 of body 110. Each lever 138 has a substantially horizontal ledge 139 for supporting the periphery of adjustment plate 136. Seal closure member 126 extends a preselected distance within interior 114 of body 110. Upon activation of sprinkler 100, the trajectory of water migrating through interior 114 is altered by a spherical top surface of plug 129. Lower section 113 of body 110 encloses guide bolts 118, prohibiting wires and other materials positioned within the ceiling from interfering with the movement of guide bolts 118. Ends 150 of levers 138 are received through apertures in a combined trigger and concealing device 10, so that trigger and concealing device 10 maintains levers 138 in an inwardly biased, or closed position. An escutcheon 152 (FIGS. 12 and 13) can be attached to lower section 113 of body 110 in proximity to bottom region. Escutcheon 152 conceals and closes the annulus between body 110 and the ceiling which results when sprinkler 100 is installed.

Turning now to FIGS. 3 through 13, the combined trigger and concealing device 10 of the present disclosure includes a first fusible plate 20 and a second fusible plate 30 joined by a heat fusible material 40 and attached to a cover 60. Heat fusible materials, often entitled heat sensitive materials, are generally known in the automatic sprinkler industry, and thus heat fusible material 40 may be any generally recognized material used in the art possessing the requisite degree of bonding strength and thermal sensitivity. The actual heat fusible material chosen for use with the combined trigger and concealing device 10 depends upon the temperature at which activation of sprinkler 100 is desired. For example purposes only, heat fusible material 40 may be solder or a thermally sensitive adhesive.

Figure 4:
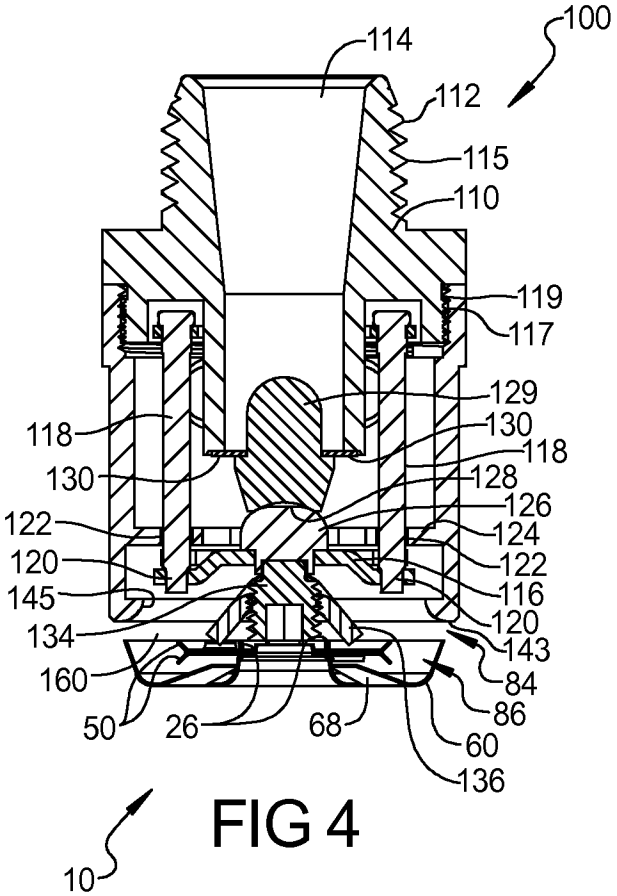
Figure 3:
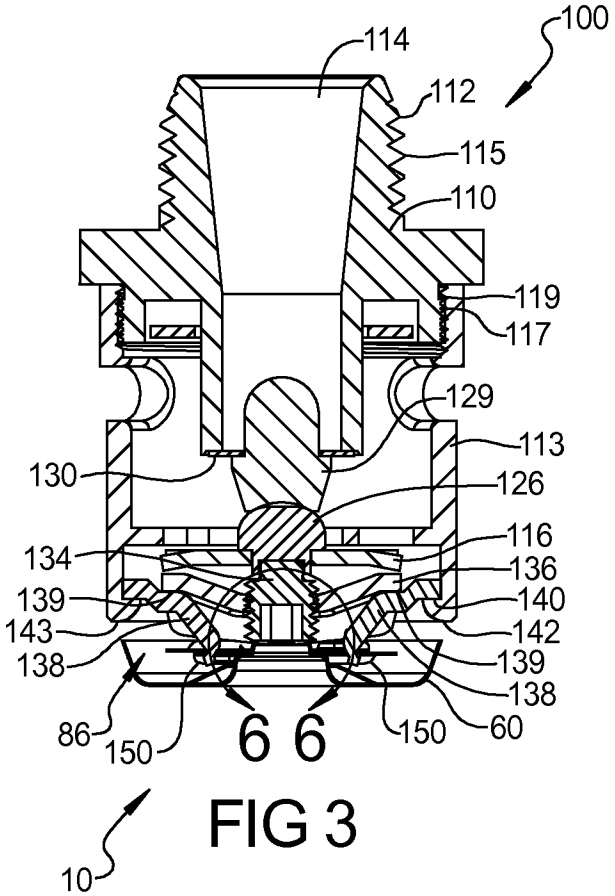
Figure 11:
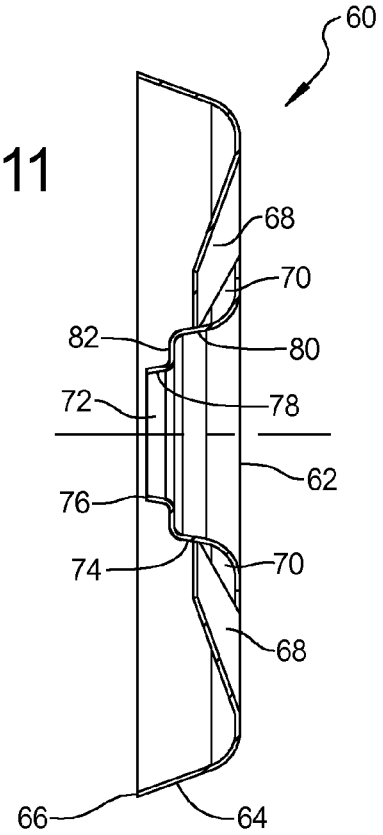
FIG. 11 is a cross-sectional view of the cover along line 11-11 of FIG. 10.

Each plate 20, 30 preferably has an eccentric shape defined by a section 44 having a uniform radius, a straight or linear section 46 opposite section 44, and a pair of substantially parallel straight or linear sections 47 extending between sections 44, 46. Plates 20, 30 may be made from any conductive material commonly employed in the art. Each plate 20, 30 contains a first aperture 22, 32 dimensioned to receive a respective one of levers 138. A hole 23, 33 formed in each plate 20, 30, permits one to insert the proper tool therethrough, enabling the tightening or loosing of adjustment screw 134 when trigger and concealing device 10 is in the assembled position. Hole 23 in first plate 20 has a larger diameter than hole 33 in second plate 30. Each plate 20, 30 is also formed with a channel 24, 34 terminating in straight section 46. As shown in FIG. 4, parallel sections 47 of each plate 20, 30 are preferably formed with a respective upturned and downturned flange or rim 50. Alternatively, plates 20, 30 may be substantially planar. Each plate 20, 30 includes a pair of projections 54 and depressions 56. First plate 20 includes a pair of upwardly extending flanges 26 adjacent hole 23. Flanges 26 can provide an obstruction to the attachment of cover 60 such that cover 60 can only be attached to plates 20, 30 from a bottom surface 35 of plate 30. This ensures a proper orientation of plates 20, 30 on trigger and concealing device 10.

Cover 60 may be made from any conductive material commonly employed in the art. By way of non-limiting example, cover 60 can be copper. Cover 60 preferably has a circular face 62 with an upturned rim 64. Rim 64 can extend radially outwardly as it extends from face 62. By way of non-limiting example, rim 64 can extend at a 70° angle relative to face 62. A peripheral edge 66 of rim 64 can define the overall diameter of cover 60. Cover 60 can include a pair of louvers 68 in face 62. Louvers 68 can be arcuate and can provide a fluid passage 70 through face 62 of cover 60. Passage 70 permits heat energy released from a fire to travel through cover 60 and transfer energy to plates 20, 30. Arcuate louvers 68 can each circumscribe an arc of approximately 100°, by way of non-limiting example. Louvers 68 can extend upwardly from face 62 at a 20° angle relative to face 62, by way of non-limiting example. Cover 60 includes a central opening 72 that permits one to insert the proper tool therethrough, enabling the tightening or loosening of adjustment screw 134 when trigger and concealing device 10 is in the assembled position. Opening 72 is defined by an upwardly extending wall 74 with an upper edge 76. An upper portion 78 of wall 74 can have a smaller diameter than a lower portion 80 with a shoulder 82 therebetween. Upper portion 78 is dimensioned to fit within holes 23, 33 of plates 20, 30.

In assembly, first and second plates 20, 30 are dipped in liquid heat fusible material 40 and subsequently removed therefrom and positioned adjacent one another with bottom or outer surface 35 of second plate 30 facing away from upper or inner surface 21 of first plate 20. Projections 54 in first plate 20 engage with depressions 56 in second plate 30 while projections 54 in second plate 30 engage with depressions 56 in first plate 20. The engagement of projections 54 with depressions 56 facilitates proper alignment of first and second plates 20, 30 relative to one another. The heat fusible material 40 solidifies thereby adhering first and second plates 20, 30 to one another. It should be appreciated that first and second plates 20, 30 can be attached together with heat fusible material 40 in a method different than a dip process. For example, heat fusible material 40 can be a solder paste where the paste is applied to the surfaces of plates 20, 30 and then plates 20, 30 are joined together in a fixture and heated in an oven which thereby solidifies the solder paste adhering first and second plates 20, 30 to one another.

Figure 13:
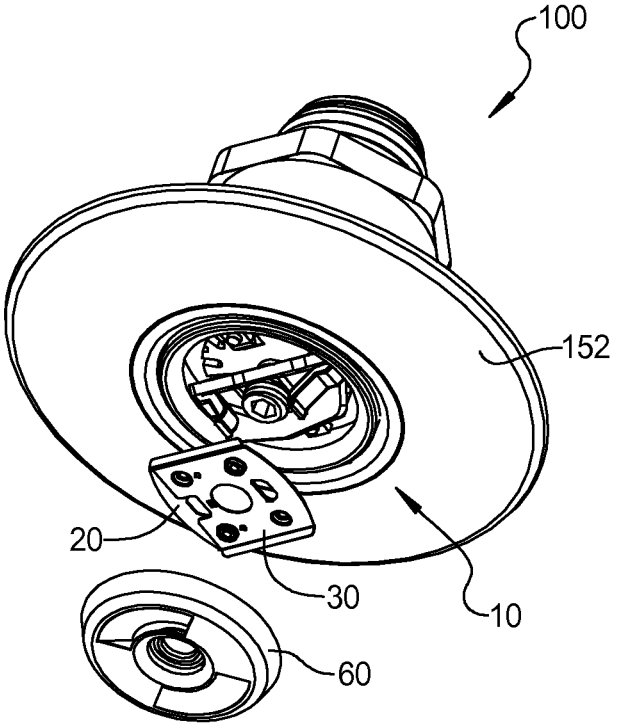

An assembly of first and second plates 20, 30 is shown in FIGS. 9 and 13. When assembled, flanges 50 of first and second plates 20, 30 face away from one another. Additionally, when attached together channel 34 of second plate 30 is in registration with aperture 22 of first plate 20. Similarly, channel 24 of first plate 20 is in registration with aperture 32 of second plate 30. Additionally, holes 23, 33 of each plate 20, 30 are in co-axial registration, thereby permitting one to insert the proper tool therethrough as necessary to tighten or loosen adjustment screw 134.

As shown in FIGS. 3, 4, 9, and 13, when assembled, first plate 20 and second plate 30 are adhered to one another in a partially overlapping position such that straight section 46 of first plate 20 is positioned adjacent uniform radius section 44 of second plate 30. Likewise, straight section 46 of second plate 30 is positioned adjacent uniform radius section 44 of first plate 20. Additionally, parallel sections 47 are aligned with flanges 50 extending away from one another.

After heat fusible material 40 solidifies and attaches first and second plates 20, 30 together, cover 60 is attached to plates 20, 30. Wall 74 of cover 60 is inserted through hole 33 in second plate 30 such that edge 76 extends above the upper or inner surface of second plate 30 with outer surface 35 resting on shoulder 82. Edge 76 is then deformed radially outwardly, such as by rolling edge 76 outwardly over the inner surface of second plate 30 adjacent hole 33, as best seen in FIG. 6. Wall 74 and rolled edge 76 can form a U-shaped annular recess within which the edge of hole 33 is disposed. Because hole 23 in first plate 20 has a greater diameter than hole 33 in second plate 30, wall 74 and edge 76 do not engage with first plate 20. As a result, cover 60 is only attached to second plate 30 and is not attached to first plate 20. Cover 60 remains with second plate 30 when sprinkler 100 is activated as described below.

With first and second plates 20, 30 attached together and cover 60 attached to second plate 30, this assembly is coupled to the rest of trigger and concealing device 10. Aperture 22 of first plate 20 receives a lever 138. Another lever 138 is received by aperture 32 of second plate 30. When so assembled, holes 23, 33 of each plate 20, 30 and opening 72 of cover 60 are in co-axial registration, thereby permitting one to insert the proper tool therethrough as necessary to tighten or loosen adjustment screw 134. As adjustment screw 134 is tightened, levers 138 that are engaged with apertures 22, 32 are biased radially outwardly by adjustment plate 136 and the resistance of fluid seal 130 and plug 129 blocking interior 114 of upper section 112 of body 110. Plates 20, 30 resist the outward bias of levers 138 and levers 138 thereby retain plates 20, 30 and cover 60 to trigger and concealing device 10.

When attached to levers 138, trigger and concealing device 10 depends a preselected distance below bottom 143 of body 110 thereby defining a passage 84 between bottom 143 and rim 64 of cover 60. The diameter of cover 60 is greater than the diameter between parallel sections 47 and is greater than the distance between radius sections 44 of plates 20, 30 and thereby defines a passage 86 between cover 60 and plates 20, 30. As shown in FIG. 5, cover 60 of trigger and concealing device 10 conceals the components of body 110 from view.

Placement of trigger and concealing device 10 a preselected distance below body 110 permits heat energy released from a fire to travel through passage 84 and passage 86 and transfer heat to inner surface 21 of first plate 20 and outer surface 35 of second plate 30. Additionally, louvers 68 in cover 60 permit heat energy released from a fire to travel through passages 70 and transfer heat to outer surface 35 of second plate 30. Openings 72 in cover 60 along with holes 23, 33 in plates 20, 30 also permit heat energy released from a fire to travel therethrough and transfer heat to inner surface 21 of first plate 20. Furthermore, cover 60 can also conduct heat energy released from a fire to the periphery of hole 33 in second plate 30 which is in contact with wall 74. Rim 64 of cover 60 which surrounds plates 20, 30 traps heat energy in and around plates 20, 30. Conduction of heat from both inner surface 21 and outer surface 35 enables the efficient conduction of heat to heat fusible material 40. This efficient heat conduction results in the prompt release or separation of plates 20 and 30. When released, cover 60 remains attached to second plate 30. Consequently, the response or actuation time of sprinkler 100 is minimized.

In preferred form, cover 60 of trigger and concealing device 10 forms an outer dimension or diameter that is at least as great as the outer dimension of deflector 116, guide bolts 118, and adjustment plate 136. When so dimensioned, trigger and concealing device 10 provides a concealing barrier that underlays and conceals the unsightly components of sprinkler 100. In most preferred form, cover 60 of trigger and concealing device 10 has a diameter of approximately 1.1 inches when used for a concealed pendant sprinkler with a K value of 4.9 GPM/(√PSI) or orifice diameter of nominal 0.407-0.411 inches. In an armed or raised position, trigger and concealing device 10 preferably forms an annular gap (height of passage 84) of approximately 1/16 inches with bottom region 142 of body 110 and rim 64 of cover 60.

Installation of sprinkler 100 is achieved by threading threaded section 111 of body 110 to the pipe (not shown) within the ceiling. In operation, under ambient conditions, trigger and concealing device 10 maintains levers 138 in an inwardly biased or closed position and thus prevents expulsion of fluid from body 110. When heat fusible material 40 is elevated to a preselected temperature due to the presence of fire, its chemical degradation or reduction in bonding strength, coupled with the force exerted on the respective plates 20, 30 by levers 138 affects the separation of first plate 20 from second plate 30. This in turn releases adjustment plate 136 causing deflector 116 to be expelled from the body 110 and depend a preselected distance within the designated area. Guide bolts 118 slide through guide holes 122 in order to act as arms spacing deflector 116 from the outlet orifice of body 110. Upon expulsion of deflector 116, downward movement of seal closure member 126 releases fluid seal 130, permitting water or other fire extinguishing fluid to travel through interior 114 of body 110 and be expelled therefrom. Thereafter, the water's trajectory is altered by deflector 116 in an optimum pattern to extinguish or suppress a fire.

It is to be understood that the foregoing is a description of the preferred embodiments. Those skilled in the art will recognize that variations, modifications and improvements may be made without departing from the spirit and scope of the disclosure disclosed herein. For example, the artisan with ordinary skill will readily understand that trigger and concealing device 10 may be used with sprinklers having internal components which differ from those depicted. For example, trigger and concealing device 10 may be used on the sprinkler shown in U.S. Pat. No. 6,152,236 entitled "Combined Trigger and Concealing Device for a Sprinkler Head" and assigned to The Viking Corporation, the disclosure of which is incorporated herein by reference. Additionally, it should be appreciated that while plates 20, 30 are shown as being generally rectangular with a constant radius edge, other shapes and configurations for plates 20, 30 can be utilized. Additionally, louvers 68 can take forms other than the arcuate shape shown. For example, cover 60 may include a plurality of openings in face 62 that permit heat energy released from a fire to travel therethrough and flow into contact with plates 20, 30. Moreover, trigger and concealing device 10 may be used with a one-piece body. Consequently, the scope of protection afforded the present disclosure is to be measured by the claims which follow in the breadth of interpretation which the law allows.

What is claimed is:

1. A trigger device for an automatic sprinkler having a deflector positioned within the interior of a sprinkler body, wherein the sprinkler is actuated when a first and a second actuator depending below the bottom of the body are moved from a closed position to an open position, said trigger device comprising:

a first plate having a first actuator aperture therethrough dimensioned to receive the first actuator;

a second plate having a second actuator aperture therethrough dimensioned to receive the second actuator, heat fusible material attaching said first and second plates together when in an assembled condition; and a cover attached to said second plate and having an outer dimension, wherein said first and second plates have an assembled outer dimension, and said cover outer dimension is approximately at least as great as the assembled outer dimension so as to substantially conceal the assembled first and second plates.

2. The trigger device as recited in claim 1, wherein said outer dimension of said cover is at least as great as an outer dimension of the deflector so as to substantially conceal the interior of the sprinkler body.

3. The trigger device as recited in claim 1, wherein said cover includes a central through hole and at least one aperture defining a passage through said cover.

4. The trigger device as recited in claim 3, wherein said at least one aperture includes at least one louver defining said passage through said cover while substantially concealing the assembled first and second plates.

5. The trigger device as recited in claim 1, wherein said first and second plates have aligned through openings when assembled and said cover has a central through opening aligned with said plate through openings when attached to one of said first and second plates.

6. The trigger device as recited in claim 5, wherein said cover through opening is defined by a wall extending from said cover and said wall is engaged with said second plate thereby attaching said cover to said second plate.

7. The trigger device as recited in claim 6, wherein said through opening in said first plate has a first diameter, said through opening in said second plate has a second diameter, and said second diameter is less than said first diameter.

8. The trigger device as recited in claim 6, wherein said second plate has opposite inner and outer surfaces, said outer surface faces said cover, and said wall engages with both of said inner and outer surfaces thereby attaching said cover to said second plate.

9. The trigger device as recited in claim 1, wherein said second plate is positioned between said first plate and said cover.

10. The trigger device as recited in claim 9, wherein said first plate includes at least one projection extending from a surface thereof and inhibits attachment of said cover to said first plate.

11. The trigger device as recited in claim 1, wherein said cover includes a substantially circular face and an upturned rim extending from said face toward the sprinkler body.

12. The trigger device as recited in claim 1, wherein said cover depends a preselected distance below the bottom of the sprinkler body, thereby defining a gap between said cover and the bottom of the sprinkler body.

13. The trigger device as recited in claim 1, wherein said cover is spaced apart from an outer periphery of said first and second plates a preselected distance.

14. The trigger device as recited in claim 1, further comprising an adjustment screw positioned below the deflector and wherein aligned openings in said first and second plates and said cover enable a tool to pass through and engage said adjustment screw.

15. The trigger device as recited in claim 1, wherein said first plate is formed with a first channel and said second plate is formed with a second channel, wherein said first channel is in registration with said second actuator aperture formed in said second plate and said second channel is in registration with said first actuator aperture formed in said first plate.

* * * * *